US006038873A

United States Patent [19]

Koo

[11] Patent Number: 6,038,873

[45] Date of Patent: Mar. 21, 2000

[54] AIR CONDITIONER CAPABLE OF CONTROLLING AN AMOUNT OF BYPASSED REFRIGERANT ACCORDING TO A TEMPERATURE OF CIRCULATING REFRIGERANT

[75] Inventor: Hyoung Mo Koo, Suwon, Rep. of Korea

[73] Assignee: SamSung Electronics Co., Ltd., Kyungki-do, Rep. of Korea

[21] Appl. No.: 09/219,520

[22] Filed: Dec. 23, 1998

[30] Foreign Application Priority Data

Apr. 30, 1998 [KR] Rep. of Korea ..... 98-15671

[51] Int. Cl.[7] ..... F25B 41/00

[52] U.S. Cl. ..... 62/196.4; 62/196.3; 62/197

[58] Field of Search ..... 62/196.3, 196.4, 62/197, 196.1, 228.3, 324.6, 211, 199, 117

[56] References Cited

U.S. PATENT DOCUMENTS

| | | | |
|---|---|---|---|
| 4,258,553 | 3/1981 | Kelly et al. | 62/117 |
| 4,509,586 | 4/1985 | Watabe | 165/29 |
| 4,658,596 | 4/1987 | Kuwahara | 62/197 |
| 4,986,084 | 1/1991 | Beckhusen | 62/197 |
| 5,148,684 | 9/1992 | Leimbach et al. | 62/197 |
| 5,243,827 | 9/1993 | Hagita et al. | 62/113 |
| 5,309,728 | 5/1994 | Chae | 62/158 |
| 5,653,119 | 8/1997 | Kimura et al. | 62/228.5 |
| 5,816,055 | 10/1998 | Ohman | 62/117 |

*Primary Examiner*—Henry Bennett
*Assistant Examiner*—Marc Norman
*Attorney, Agent, or Firm*—Robert E. Bushnell, Esq.

[57] ABSTRACT

A multiple type air conditioner has an outdoor unit and multiple indoor units. The outdoor unit has a compressor and an outdoor heat exchanger. Each indoor unit has an indoor heat exchanger. A bypass pipe connects the outdoor heat exchanger to the compressor, and the opening degree of the bypass pipe is controlled by a bypass valve. The temperature of the refrigerant circulating from the indoor heat exchanger to the compressor is sensed by a sensor. As the temperature of the refrigerant sensed by the sensor increases, the opening degree of the bypass pipe decreases. Thus, the amount of refrigerant supplied to the indoor heat exchanger and that of refrigerant bypassed by the bypass pipe are controlled according to the temperature of the refrigerant, whereby the cooling efficiency is enhanced. Further, the difference in pressure between the refrigerant flowing out of the indoor heat exchanger and that flowing out of the bypass pipe is lowered, whereby noise is reduced.

2 Claims, 3 Drawing Sheets

AIR CONDITIONER CAPABLE OF CONTROLLING AN AMOUNT OF BYPASSED REFRIGERANT ACCORDING TO A TEMPERATURE OF CIRCULATING REFRIGERANT

BACKGROUND OF THE INVENTION

1. Field of the Invention

The present invention relates to an air conditioner, and more particularly, to a multiple type air conditioner having a single outdoor unit and a plurality of indoor units.

2. Prior Art

In general, an air conditioner has an indoor unit installed in a room, and an outdoor unit installed outside the room. The indoor unit has an indoor heat exchanger to exchange heat with indoor air, and the outdoor unit has an outdoor heat exchanger to exchange heat with outdoor air.

A so-called multiple type air conditioner has been proposed, which operates a plurality of indoor units respectively installed in several places, using a single outdoor unit. Such a multiple type air conditioner, as shown in FIG. 3, has a single outdoor unit 52 and a plurality of indoor units 51. FIG. 3 shows a multiple type air conditioner having two indoor units 51, that is, a first and a second indoor units 51*a* and 51*b*.

The outdoor unit 52 has a compressor 53 to compress gaseous refrigerant to a high-temperature and high-pressure state, and an outdoor heat exchanger 54 to condense the refrigerant into a liquid refrigerant in a low-temperature and low-pressure state, by exchanging heat of the refrigerant compressed by the compressor 53 with outdoor air.

The first indoor unit 51*a* and the second indoor unit 51*b* respectively have a first indoor heat exchanger 55*a* and a second indoor heat exchanger 55*b*. The indoor heat exchangers 55 are connected with the compressor 53 by a first refrigerant pipe 58, the compressor 53 is connected with the outdoor heat exchanger 54 by the second refrigerant pipe 68, and the outdoor heat exchanger 54 is connected with the indoor heat exchangers 55 by a third refrigerant pipe 78. The first refrigerant pipe 58 is branched to a pair of branch pipes 75*a* and 75*b*, and the branch pipes 75*a* and 75*b* are connected to a pair of indoor heat exchangers 55*a* and 55*b*, respectively. The third refrigerant pipe 78 is also branched to a pair of branch pipes 65*a* and 65*b*, and the branch pipes 65*a* and 65*b* are connected to a pair of indoor heat exchangers 55*a* and 55*b*, respectively.

Valves 61*a* and 61*b* are respectively installed on the branch pipes 65*a* and 65*b* of the third refrigerant pipe 78. The valves 61*a* and 61*b* open and close the respective branch pipes 65*a* and 65*b*, and control the supply of refrigerant into the corresponding indoor heat exchangers 55*a* and 55*b*.

The first refrigerant pipe 58 and the second refrigerant pipe 68 intersect each other in one point, and a four-way valve 64 is installed on the intersecting point. According to operation of the four-way valve 64, the refrigerant compressed by the compressor 53 is supplied to the outdoor heat exchanger 54 or the indoor heat exchangers 55, selectively. Thus, the direction of the refrigerant is changed by the four-way valve 64, and thereby, the heating or cooling operations of the indoor air are performed selectively.

Meanwhile, such an air conditioner exchanges heat in the first and second indoor heat exchangers 55*a* and 55*b*, using the refrigerant compressed in a single compressor 53, so a compressor 53 having double the required capacity of compression in one indoor heat exchanger is employed. Thus, the compression capacity of the compressor 53 is surplus where either 55*a* or 55*b* of the indoor heat exchangers is being used, and therefore, a bypass pipe 70 is provided, in order to bypass the surplus compressed refrigerant.

The bypass pipe 70 connects a portion of the first refrigerant pipe 58 adjacent to the inlet of the compressor 53 to the outdoor heat exchanger 54 so that a part of the compressed refrigerant supplied from the compressor 53 into the outdoor heat exchanger 54 is directly circulated into the compressor 53. Furthermore, a bypass valve 71 is installed on the bypass pipe 70, which is generally comprised of a solenoid valve, and a capillary tube 72 for expanding the refrigerant bypassed toward the compressor 53 is disposed on the end portion of the bypass pipe 70.

While all of the indoor units 55 are operating, the bypass valve 71 closes the bypass pipe 70, and the valves 61 open the branch pipes 65. Then, the refrigerant compressed by the compressor 53 is circulated via the outdoor heat exchanger 54, the third refrigerant pipe 78, the branch pipes 65, the indoor heat exchangers 55, the branch pipes 75, the first refrigerant pipe 58, and the compressor 53, successively. In this course, the refrigerant is condensed in the outdoor heat exchanger 54 to thereby radiate heat, and the refrigerant evaporates in the indoor heat exchangers 55 to thereby absorb heat. Thus, the indoor air is cooled.

Meanwhile, while either of the indoor units 51*a* and 51*b*, for example the first indoor unit 51*a*, is operating, the bypass valve 71 opens the bypass pipe 70, the valve 61*a* opens the branch pipe 65*a*, and the valve 61*b* closes the branch pipe 65*b*. Then, the refrigerant compressed by the compressor 53 is circulated via the outdoor heat exchanger 54, the third refrigerant pipe 78, the branch pipe 65*a*, the first indoor heat exchanger 55*a*, the branch pipe 75*a*, the first refrigerant pipe 58, and the compressor 53, successively, and thereby, only the first indoor unit 51*a* performs the cooling operation. In this course, a part of the refrigerant flowing into the outdoor heat exchanger 54 is directly circulated into the compressor 53 via the bypass pipe 70 and the capillary tube 72.

However, in such a conventional multiple type air conditioner, the radius of and the length of the capillary tube 72 are predetermined when the outdoor unit 52 is manufactured, in consideration of the amount of the refrigerant to be expanded therein, so the amount of refrigerant flowing into the bypass pipe 70 cannot be adjusted in response to the change in length of the refrigerant pipe 78 for supplying the refrigerant into the indoor heat exchangers 55. In other words, temperature and pressure of the refrigerant which has passed through the indoor unit 51 vary from time to time according to operational states of the air conditioner; however, temperature and pressure of the refrigerant which has passed through the capillary tube 72 are constant. Therefore, when the refrigerant passing through the bypass pipe 70 meets the refrigerant circulated through the first indoor unit 55*a* in the first refrigerant pipe 58, noise is generated due to a difference in pressure between these refrigerants, and thereby, the operational efficiency of the compressor 53 is lowered.

SUMMARY OF THE INVENTION

The present invention has been proposed to overcome the above-described problems in the prior art, and accordingly, it is the object of the present invention to provide a multiple type air conditioner capable of enhancing the cooling efficiency thereof, and reducing noise caused by the difference in pressure between the refrigerant bypassed through the bypass pipe and the refrigerant circulated through the indoor unit.

To achieve the above object, the present invention provides an air conditioner comprising: an outdoor unit having a compressor for compressing refrigerant, and an outdoor heat exchanger for exchanging heat of the refrigerant supplied from the compressor with outdoor air; a plurality of indoor units respectively having an indoor heat exchanger for exchanging heat of the refrigerant supplied from the outdoor heat exchanger with indoor air; a bypass pipe connecting the outdoor heat exchanger with the compressor, to bypass a part of the refrigerant supplied to the outdoor heat exchanger into the compressor; a bypass valve for controlling an opening degree of the bypass pipe; a temperature sensor for sensing a temperature of the refrigerant circulating from the indoor heat exchanger to the compressor; and a control part for controlling the bypass valve, so the opening degree of the bypass pipe decreases as the temperature of the refrigerant sensed by the temperature sensor increases.

The control part controls the bypass valve so that the bypass pipe is closed while all of the indoor units are operating.

Since the amount of the refrigerant supplied into the indoor heat exchanger is increased when the temperature of circulated refrigerant is increased, the amount of the refrigerant supplied to the indoor heat exchanger is properly controlled according to operational states of the indoor units. Therefore, the efficiency of exchanging heat of the indoor units is enhanced. Furthermore, the difference in pressure between the refrigerant circulated into the compressor and the bypassed refrigerant is reduced, and thereby, noise is reduced.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the accompanying drawings.

Figure 1:
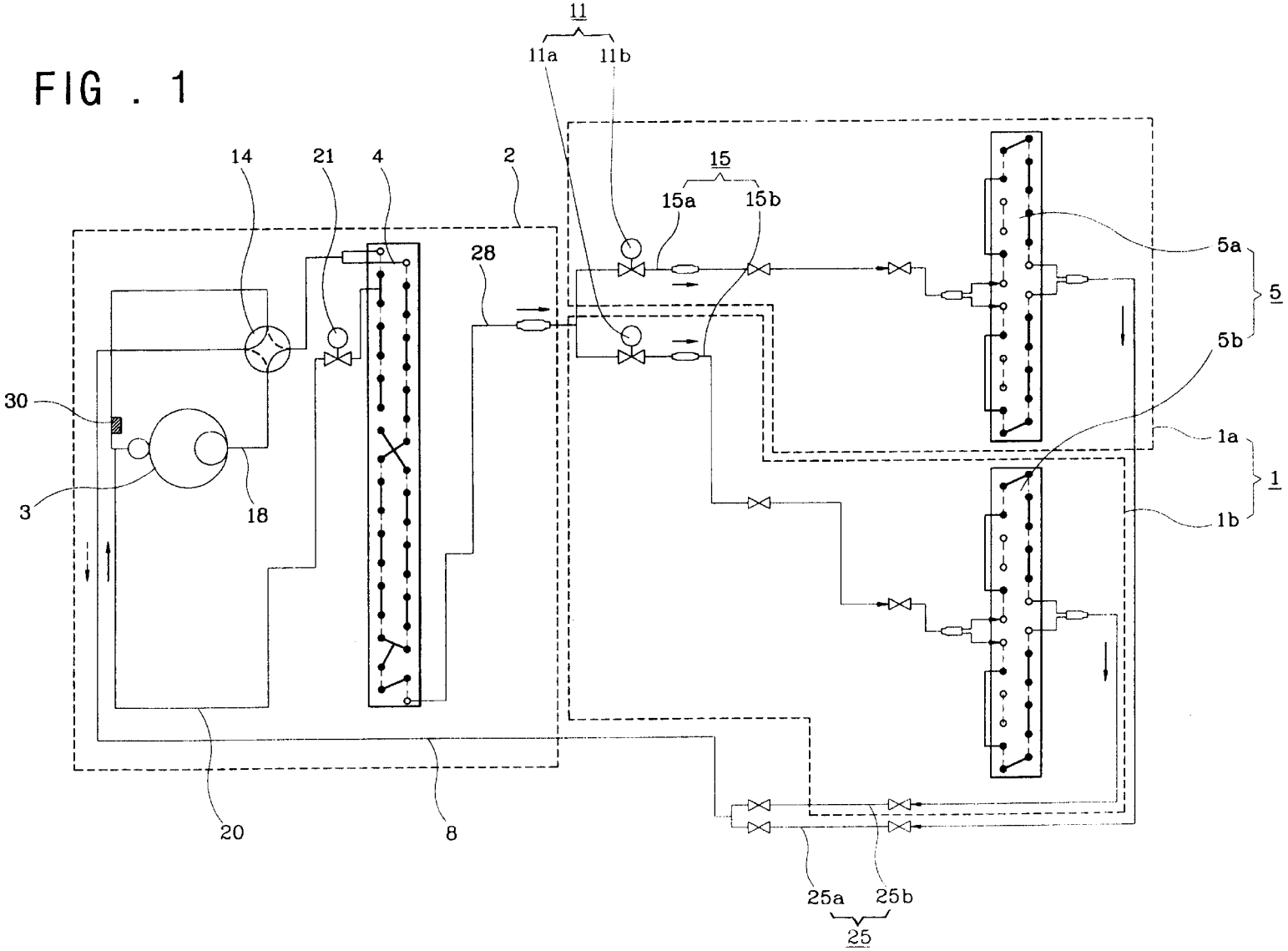
FIG. 1 is a schematic view of a multiple type air conditioner according to the present invention.

As shown in FIG. 1, a multiple type air conditioner has a single outdoor unit 2 and a plurality of indoor units 1. A multiple type air conditioner, as shown in FIG. 1, has two indoor units 1, that is, a first and a second indoor units 1*a* and 1*b*.

The outdoor unit 2 has a compressor 3 for compressing a gaseous refrigerant to a high-temperature and high pressure state, and an outdoor heat exchanger 4 for condensing the refrigerant into a liquid refrigerant in a-low temperature and low-pressure state, by exchanging heat of the refrigerant compressed by the compressor 3 with outdoor air.

The first indoor unit 1*a* and the second indoor unit 1*b* respectively have a first indoor heat exchanger 5*a* and a second indoor heat exchanger 5*b*. The indoor heat exchangers 5 are connected with the compressor 3 by a first refrigerant pipe 8, the compressor 3 is connected with the outdoor heat exchanger 4 by the second refrigerant pipe 18, and the outdoor heat exchanger 4 is connected with the indoor heat exchanger 5 by a third refrigerant pipe 28.

The first refrigerant pipe 8 is branched to a pair of branch pipes 25*a* and 25*b*, and the branch pipes 25*a* and 25*b* are connected to a pair of indoor heat exchangers 5*a* and 5*b* respectively. The third refrigerant pipe 28 is also branched to a pair of branch pipes 15*a* and 15*b*, and the branch pipes 15*a* and 15*b* are connected to a pair of indoor heat exchangers 5*a* and 5*b* respectively.

Valves 11*a* and 11*b* are respectively installed on the branch pipes 15*a* and 15*b* of the third refrigerant pipe 28. The valves 11*a* and 11*b* open and close the respective branch pipes 15*a* and 15*b*, and control the supply of refrigerant into the corresponding indoor heat exchangers 5*a* and 5*b*.

The first refrigerant pipe 8 and the second refrigerant pipe 18 intersect each other in one point and a four-way valve 14 is installed on the intersecting point. According to operation of the four-way valve 14, the refrigerant compressed by the compressor 3 is supplied to the outdoor heat exchanger 4 or the indoor heat exchangers 5 selectively. Thus, the direction of the refrigerant is changed by the four-way valve 14, and thereby the heating or cooling operations of the indoor air are selectively performed.

Describing it in more detail, when the refrigerant compressed by the compressor 3 is supplied to the outdoor heat exchanger 4 by the four-way valve 14, the refrigerant is circulated along the direction designated by the solid arrow, via the outdoor heat exchanger 4, the third refrigerant pipe 28, the branch pipes 15, the indoor heat exchangers 5, the branch pipes 25, the first refrigerant pipe 8, and the compressor 3, successively. In this course, the refrigerant is condensed in the outdoor heat exchanger 4 to thereby radiate heat, and the refrigerant evaporates in the indoor heat exchangers 5 to thereby absorb heat. Thus, the indoor air is cooled.

Meanwhile, when the refrigerant compressed by the compressor 3 is supplied to the indoor heat exchanger 5 by the four-way valve 14, the refrigerant is circulated along the direction designated by the dotted arrow, via the first refrigerant pipe 8, the indoor heat exchangers 5, the branch pipes 15, the third refrigerant pipe 28, the outdoor heat exchanger 4, and the compressor 3, successively. In this course, the refrigerant is condensed in the indoor heat exchangers 5 to thereby radiate heat, and the refrigerant evaporates in the outdoor heat exchangers 4 to thereby absorb heat. Thus, the indoor air is heated.

A bypass pipe 20 is provided between the outdoor heat exchanger 4 and the compressor 3, in order to bypass a part of the refrigerant flowing into the outdoor heat exchanger 4. The bypass pipe 20 connects a portion of the first refrigerant pipe 8 adjacent to the inlet of the compressor 3 with the outdoor heat exchanger 4 so that a part of the compressed refrigerant supplied from the compressor 3 into the outdoor heat exchanger 4 is directly circulated into the compressor 3. A bypass valve 21 is installed on the bypass pipe 20. Like the bypass valve 21, an electrical valve capable of controlling the opening degree thereof is employed.

A temperature sensor 30 is installed on the first refrigerant pipe 8 in one point adjacent to the compressor 3. The temperature sensor 30 senses the temperature of the refrigerant flowing into the compressor 3.

Figure 2:
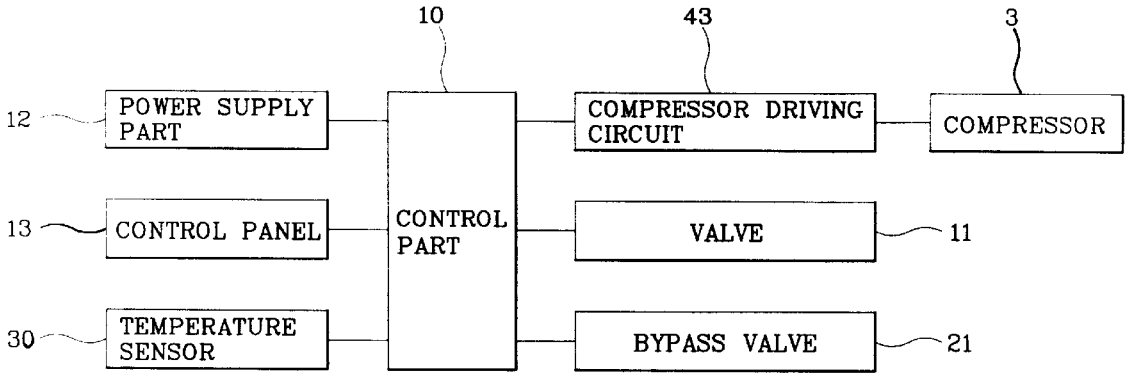
FIG. 2 is a block diagram of the multiple type air conditioner shown in FIG. 1.
Figure 3:
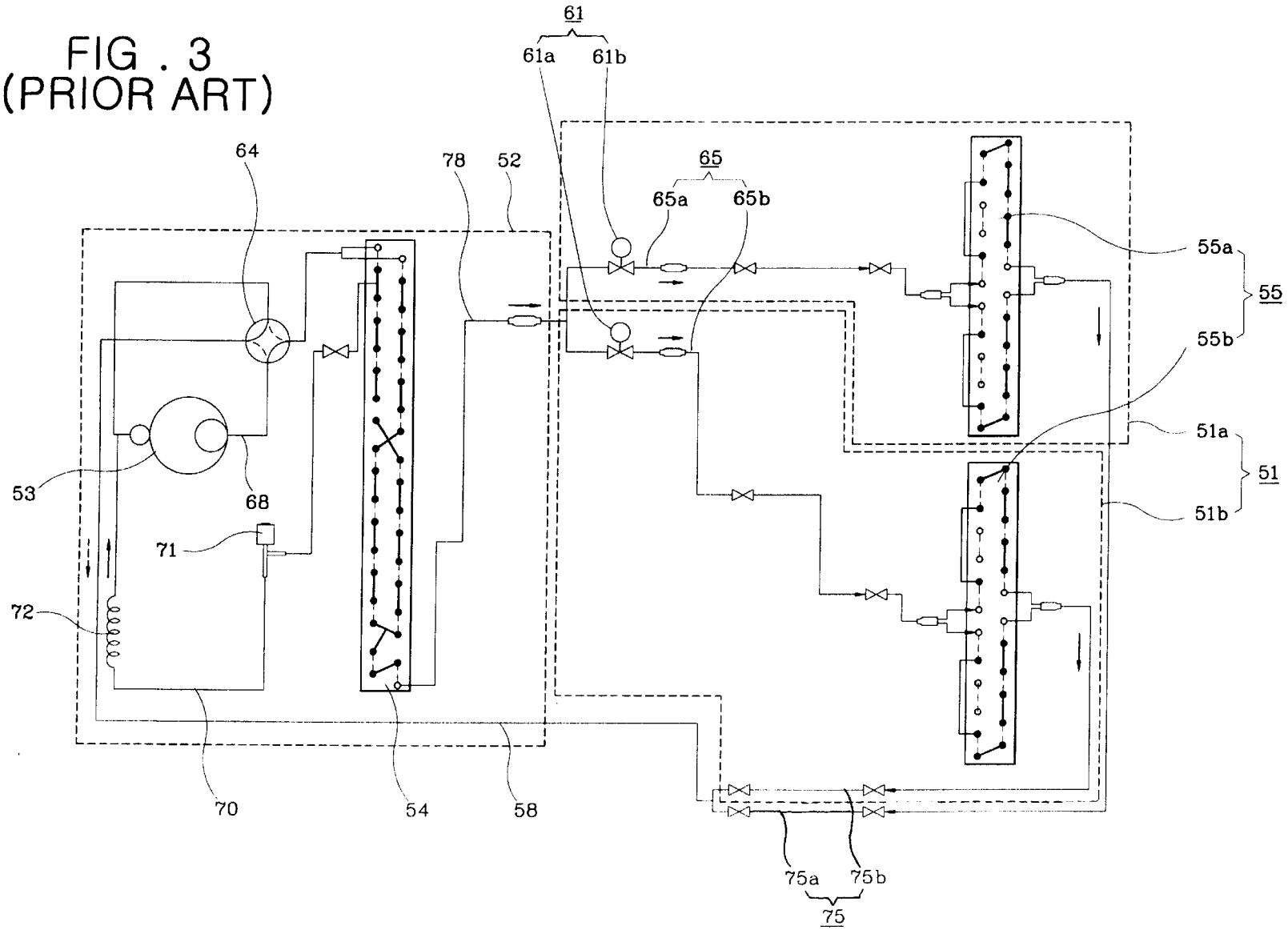
FIG. 3 (PRIOR ART)
FIG. 3 is a schematic view of a conventional multiple type air conditioner.

FIG. 2 is a block diagram of the multiple type air conditioner shown in FIG. 1. A control part 10 is operated when electrical power is supplied from the power supply part 12, and signals from a control panel 13 and the temperature sensor 30 are input to the control part 10. A user operates the control panel 13 to select the operational mode of the air conditioner.

The control part 10 controls the operation of the compressor 3 through the compressor driving circuit 43, and controls the valves 11 and the bypass valve 21 according to the operational state set by the control panel 13. Furthermore, the control part 10 controls the bypass valve 21 on the basis of the signal from the temperature sensor 30.

Hereinbelow, the operation of the air conditioner according to the present invention having the above-described construction will be described.

While all of the indoor units 5 are operating, the control part 10 controls the bypass valve 21 so as to close the bypass pipe 20, and controls the valves 11 so as to open the branch pipes 15. Then, the refrigerant compressed by the compressor 3 is circulated via the outdoor heat exchanger 4, the third refrigerant pipe 28, the branch pipes 15, the indoor heat exchangers 5, the branch pipes 25, the first refrigerant pipe 8, and the compressor 3, successively. In this course, the refrigerant is condensed in the outdoor heat exchanger 4 to thereby radiate heat, and the refrigerant evaporates in the indoor heat exchanger 5 to thereby absorb heat. Thus, the indoor air is cooled.

While either of the indoor units 1*a* and 1*b*, for example, the first indoor unit 1*a*, is operating, the control part 10 controls the bypass valve 21 so as to open the bypass pipe 20, and controls the valves 11*a* and 11*b* so as to open the branch pipe 15*a* and close the branch pipe 15*b*. Then, the refrigerant compressed by the compressor 3 is circulated via the outdoor heat exchanger 4, the third refrigerant pipe 28, the branch pipe 15*a*, the first indoor heat exchanger 5*a*, the branch pipe 25*a*, the first refrigerant pipe 8, and the compressor 3 successively, and thereby, only the first indoor unit 1 a performs the cooling operation. In this course, a part of the refrigerant flowing into the outdoor heat exchanger 4 is directly circulated into the compressor 3 via the bypass pipe 20. The refrigerant supplied into the bypass pipe 20 is expanded and its pressure is reduced in the bypass pipe 20, and the refrigerant is, then, supplied into the compressor 3.

The temperature sensor 30 senses the temperature of the refrigerant flowing into the compressor 3 through the first refrigerant pipe 8. When the sensed temperature is higher than a predetermined temperature, the control part 10 controls the bypass valve 21 so as to decrease the opening degree of the bypass pipe 20. Then, the amount of the refrigerant flowing into the is bypass pipe 20 is decreased; instead, that of the refrigerant flowing into the first indoor heat exchanger 5*a* is increased. Since the amount of the refrigerant supplied into the first indoor heat exchanger 5*a* is increased, the temperature of the refrigerant circulated into the compressor 3 through the first refrigerant pipe 8 descends. Therefore, the difference in temperature between the circulating refrigerant and the bypassed refrigerant is reduced, and the pressure difference thereof is also reduced. Accordingly, the noise caused by the pressure difference is reduced.

Meanwhile, when the temperature sensed by the temperature sensor 30 is lower than a predetermined temperature, the control part 10 controls the bypass valve 21 so as to increase the opening degree of the bypass pipe 20. Then, the amount of the refrigerant flowing into the bypass pipe 20 is increased; instead, that of the refrigerant flowing into the first indoor heat exchanger 5*a* is decreased. Since the amount of the refrigerant supplied into the first indoor heat exchanger 5*a* is decreased, the temperature of the refrigerant circulated into the compressor 3 through the first refrigerant pipe 8 ascends. Therefore, the temperature difference between the circulating refrigerant and the bypassed refrigerant is reduced, and the pressure difference thereof is also reduced. Accordingly, the noise caused by the pressure difference is reduced.

Meanwhile, since the amount of the refrigerant supplied into the indoor heat exchanger 5 is increased when the temperature of circulated refrigerant is increased, the amount of the refrigerant supplied to the indoor heat exchanger 5 is properly controlled according to the operational environment of the indoor units 1. In other words, when a large amount of refrigerant is needed in the indoor heat exchanger 5, the amount of the refrigerant supplied into the indoor heat exchanger 5 is increased, and when a small amount of refrigerant is need in the indoor heat exchanger 5, the amount of refrigerant supplied into the indoor heat exchanger 5 is reduced. Therefore, the efficiency of exchanging heat of the indoor units 1 is enhanced.

As described above, according to the present invention, the difference in pressure between the refrigerant circulated into the compressor and the bypassed refrigerant is reduced and thereby the noise is lowered. Further, the amount of refrigerant supplied into the indoor units is properly adjusted, and thereby, the cooling efficiency is improved.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. An air conditioner comprising:

an outdoor unit having a compressor for compressing refrigerant, and an outdoor heat exchanger for exchanging heat of the refrigerant supplied from the compressor with outdoor air;

a plurality of indoor units respectively having an indoor heat exchanger for exchanging heat of the refrigerant supplied from the outdoor heat exchanger with indoor air;

a bypass pipe connecting the outdoor heat exchanger with the compressor so as to bypass a part of the refrigerant supplied to the outdoor heat exchanger into the compressor;

a bypass valve for controlling an opening degree of the bypass pipe;

a temperature sensor for sensing a temperature of the refrigerant circulating from the indoor heat exchanger to the compressor; and a control part for controlling the bypass valve so that the opening degree of the bypass pipe decreases as the temperature of the refrigerant sensed by the temperature sensor increases.

2. The air conditioner as claimed in claim 1, wherein the control part controls the bypass valve so that the bypass pipe is closed while all of the indoor units are operating.

* * * * *